US005475949A

United States Patent [19]

McCoy

[11] Patent Number: 5,475,949

[45] Date of Patent: Dec. 19, 1995

[54] TELESCOPING CEILING CLOSET

[76] Inventor: Neville W. McCoy, P.O. Box 64, 240 New England Ave., Pinebluff, N.C. 28373

[21] Appl. No.: 310,382

[22] Filed: Sep. 22, 1994

[51] Int. Cl.[6] ..... A47B 51/00; B66B 9/02

[52] U.S. Cl. ..... 52/67; 52/29; 312/242

[58] Field of Search ..... 52/67, 64, 29; 312/242, 247

[56] References Cited

U.S. PATENT DOCUMENTS

| | | | |
|---|---|---|---|
| 982,056 | 1/1911 | Hammell . | |
| 1,078,249 | 11/1913 | Burns . | |
| 2,086,002 | 7/1937 | Shepard . | |
| 2,382,354 | 8/1945 | Wales | 312/247 X |
| 2,499,791 | 3/1950 | Spencer | 312/247 X |
| 2,506,086 | 5/1950 | Jess | 312/247 |
| 2,592,760 | 4/1952 | Sutera . | |
| 2,910,335 | 10/1959 | Wales . | |
| 3,467,460 | 9/1969 | Acker | 312/242 |
| 4,076,351 | 2/1978 | Wyant | 312/247 |
| 4,412,601 | 11/1983 | Cooper | 312/247 X |
| 4,711,257 | 12/1987 | Kobayashi | 52/67 X |
| 5,203,619 | 4/1993 | Welsch et al. | 312/242 X |

*Primary Examiner*—Carl D. Friedman
*Assistant Examiner*—Robert J. Canfield

[57] ABSTRACT

A closet for storing objects within a space above a ceiling structure of a building. The inventive device includes an enclosure securable to the joists above the ceiling. A storage structure is telescopingly received within the enclosure and can be lowered therefrom into the interior of the building for access thereto. The storage structure includes a hanger bar and a shelf for storing hanging clothes and other objects therewithin. A retracting mechanism effects return of the storage structure within the enclosure and may include either return springs or a motorized drive.

2 Claims, 4 Drawing Sheets

TELESCOPING CEILING CLOSET

BACKGROUND OF THE INVENTION

1. Field of the Invention

The present invention relates to closet structures and more particularly pertains to a telescoping ceiling closet for storing objects within a space above a ceiling of a structure.

2. Description of the Prior Art

The use of closet structures is known in the prior art. More specifically, closet structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art closet structures include U.S. Pat. Nos. 4,412,601; 4,076,351; 4,060,292; 4,026,434; and 3,956,780.

While these devices fulfill their respective, particular objectives and requirements, the aforementioned patents do not disclose a telescoping ceiling closet for storing objects within a space above a ceiling structure which includes an enclosure securable to the joists above the ceiling, and a storage structure telescopingly received within the enclosure which may be lowered therefrom into the interior of the building for access thereto, wherein the storage structure includes a hanger bar and a shelf for storing hanging clothes and other objects therein. Furthermore, none of the known prior art closet structures teach or suggest a telescoping ceiling closet of the aforementioned structure which further includes a retracting mechanism for effecting return of the storage structure within the enclosure that may include either return springs or a motorized drive.

In these respects, the telescoping ceiling closet according to the present invention substantially departs from the conventional concepts and designs of the prior art, and in so doing provides an apparatus primarily developed for the purpose of storing objects within a space above a ceiling of a building.

SUMMARY OF THE INVENTION

In view of the foregoing disadvantages inherent in the known types of closet Structures now present in the prior art, the present invention provides a new telescoping ceiling closet construction wherein the same can be utilized for storing objects within a space above a ceiling. As such, the general purpose of the present invention, which will be described subsequently in greater detail, is to provide a new telescoping ceiling closet apparatus and method which has many of the advantages of the closet structures mentioned heretofore and many novel features that result in a telescoping ceiling closet which is not anticipated, rendered obvious, suggested, or even implied by any of the prior art closet structures, either alone or in any combination thereof.

To attain this, the present invention generally comprises a closet for storing objects within a space above a ceiling structure of a building. The inventive device includes an enclosure securable to the joists above the ceiling. A storage structure is telescopingly received within the enclosure and can be lowered therefrom into the interior of the building for access thereto. The storage structure includes a hanger bar and a shelf for storing hanging clothes and other objects therewithin. A retracting mechanism effects return of the storage structure within the enclosure and may include either return springs or a motorized drive.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new telescoping ceiling closet apparatus and method which has many of the advantages of the closet structures mentioned heretofore and many novel features that result in a telescoping ceiling closet which is not anticipated, rendered obvious, suggested, or even implied by any of the prior art closet structures, either alone or in any combination thereof.

It is another object of the present invention to provide a new telescoping ceiling closet which may be easily and efficiently manufactured and marketed.

It is a further object of the present invention to provide a new telescoping ceiling closet which is of a durable and reliable construction.

An even further object of the present invention is to provide a new telescoping ceiling closet which is susceptible of a low cost of manufacture with regard to both materials and labor, and which accordingly is then susceptible of low prices of sale to the consuming public, thereby making such telescoping ceiling closets economically available to the buying public.

Still yet another object of the present invention is to provide a new telescoping ceiling closet which provides in the apparatuses and methods of the prior art some of the advantages thereof, while simultaneously overcoming some of the disadvantages normally associated therewith.

Still another object of the present invention is to provide a new telescoping ceiling closet for storing objects within a space above a ceiling structure of a building.

Yet another object of the present invention is to provide a new telescoping ceiling closet which includes an enclosure securable to the joists above the ceiling, and a storage structure telescopingly received within the enclosure which may be lowered therefrom into the interior of the building for access thereto, wherein the storage structure includes a hanger bar and a shelf for storing hanging clothes and other objects therein.

Even still another object of the present invention is to provide a new telescoping ceiling closet of the aforementioned structure which further includes a retracting mechanism for effecting return of the storage structure within the enclosure, wherein the retracting mechanism includes either return springs or a motorized drive.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
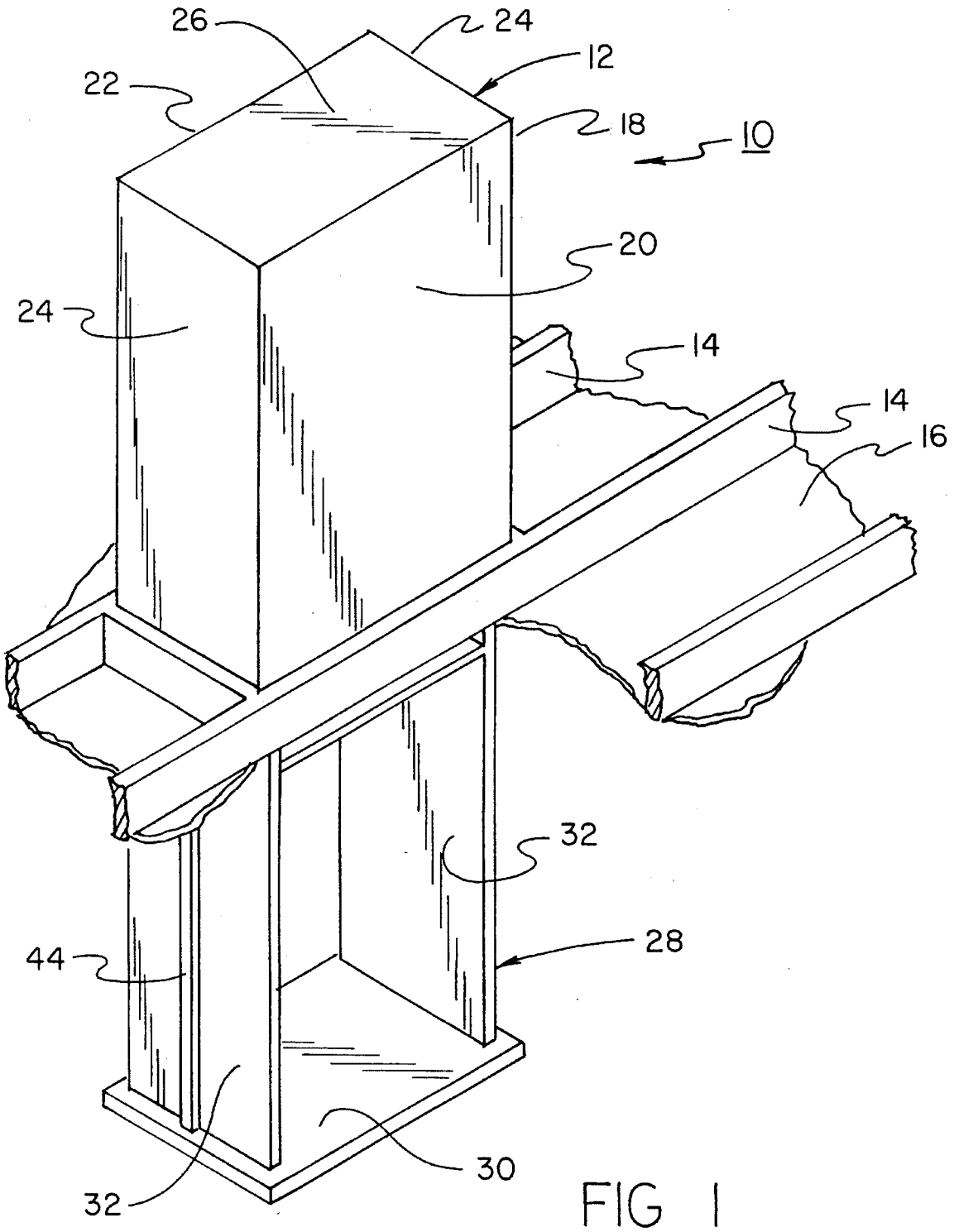
FIG. 1 is an isometric illustration of a telescoping ceiling closet according to the present invention as installed within a ceiling structure.

With reference now to the drawings, and in particular to FIGS. 1–7 thereof, a new telescoping ceiling closet embodying the principles and concepts of the present invention and generally designated by the reference numeral 10 will be described.

More specifically, it will be noted that the telescoping ceiling closet 10 comprises an enclosure means 12 for receiving and storing objects therewithin which can be mounted between spaced joists 14 above the ceiling 16 of an unlabelled building structure, such as a house or the like. The enclosure means 12 comprises a container 18 having a substantially rectangular cross section and including a front wall 20 spaced from a rear wall 22, with a pair of side walls 24 extending orthogonally between the front and rear walls. A top wall 26 extends orthogonally across upper edges of the front and rear walls 20, 22 as well as the side walls 24 to close an upper end of the rectangular container 18. A lower end of the container 18 is open and is positioned into flush engagement with a rectangular aperture formed in the ceiling 16 between the joists 14 whereat the enclosure means 12 is mounted.

Figure 2:
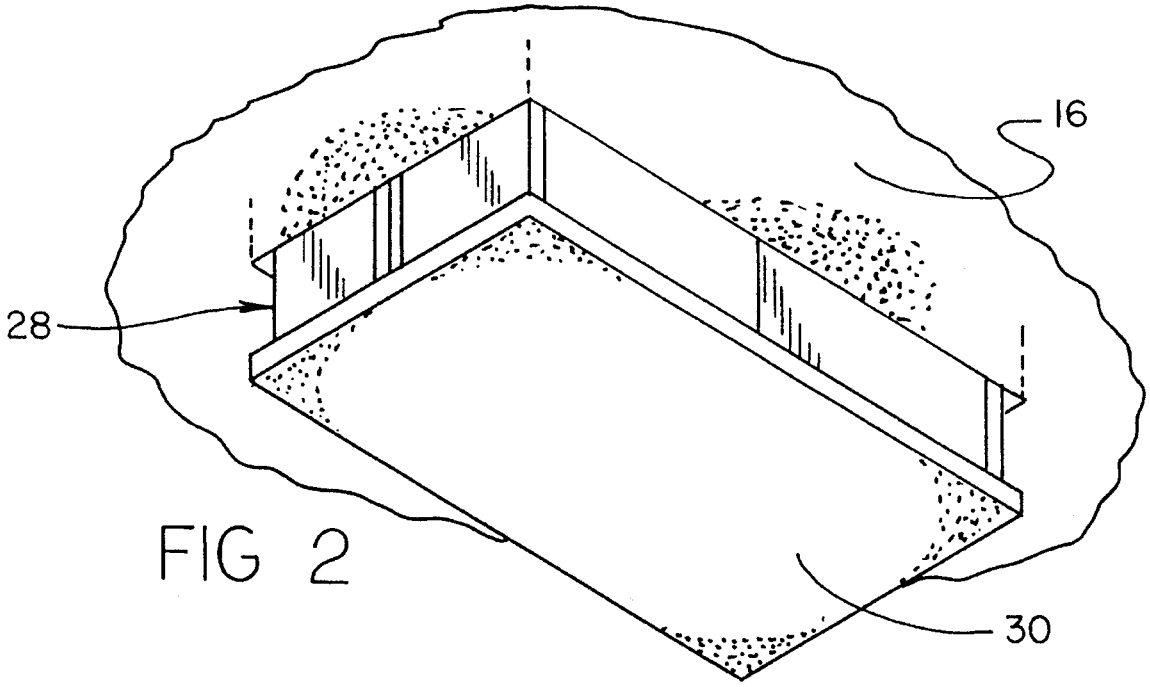
FIG. 2 is a bottom isometric view of the ceiling closet in a partially extended position.
Figure 3:
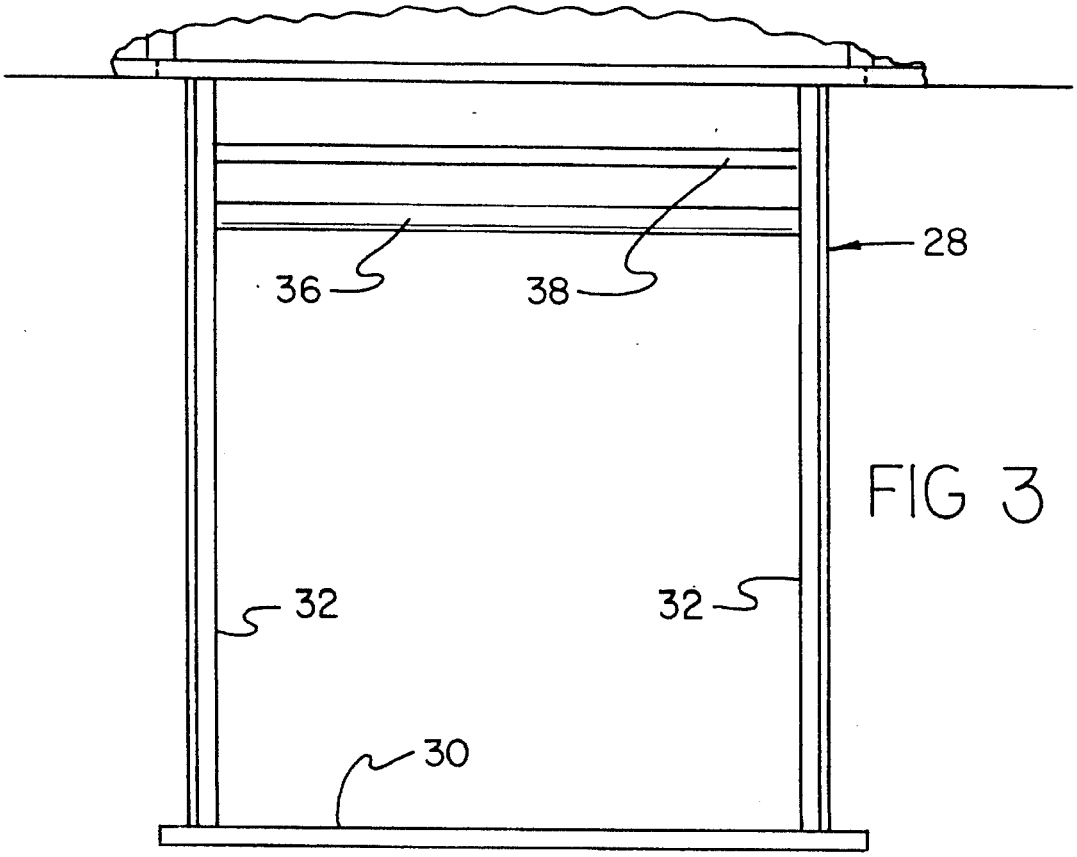
FIG. 3 is a front elevation view of the ceiling closet extended from the ceiling structure.
Figure 4:
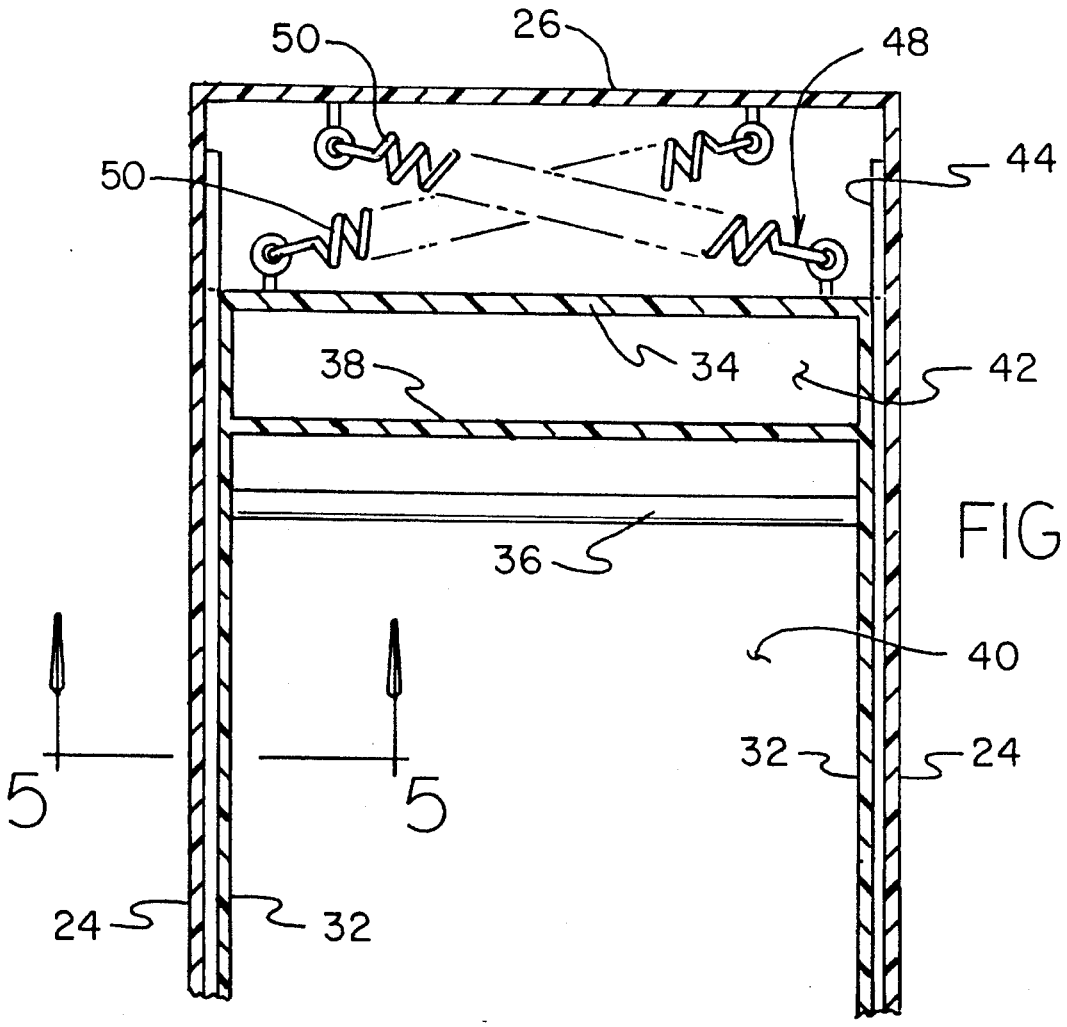
FIG. 4 is a cross-sectional view of the device.

A storage means 28 for receiving and supporting objects to be stored within the enclosure means 12 is slidably mounted to an interior of the rectangular container 18 and can be telescopingly positioned therewithin. To this end, the storage means 28 comprises a substantially rectangular base panel 30 having an exterior texture matching that of the surrounding ceilings 16, as shown in FIG. 2. A pair of vertical panels 32 orthogonally extend from an unfinished side of the base panel 30 in a substantially parallel, spaced relationship relative to one another. The vertical panels 32 extend upwardly from the base panel 30 to connect with a top panel 34 extending orthogonally therebetween. A hanger bar 36 extends between the vertical panels 32 and can be utilized for hanging clothes hangers and associated clothes thereacross. Further, a shelf panel 38 orthogonally extends between the vertical panels, as shown in FIGS. 3 and 4, to divide the storage means 28 into a main compartment 40 and an auxiliary compartment 42. Preferably, the main compartment 40 is substantially greater in volume compared to the auxiliary compartment 42 such that large clothing items and the like may be hung from the hanger bar 36, with smaller items, such as shoes or the like being positioned on top of the shelf panel 38 within the auxiliary compartment 42.

Figure 5:
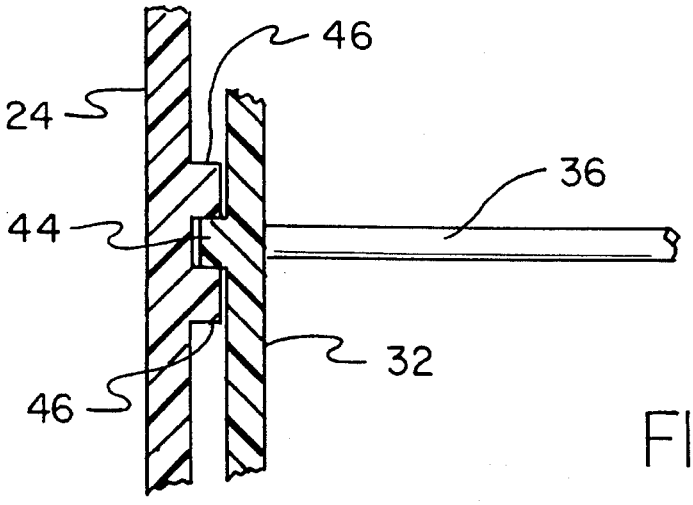
FIG. 5 is a further cross-sectional view taken along line 5—5 of FIG. 4.

To guide the storage means 28 into the enclosure means 12 during telescoping movement of the storage means into the rectangular container 18, each of the vertical panels 32 includes a longitudinal projection 44 extending along an exterior surface thereof. As shown in FIG. 5, the longitudinal projection 44 is received within a pair of spaced guide rails 46 correspondingly positioned along an interior surface of the side walls 24 of the rectangular container 18. By this structure, the storage means 28 is guided and supported relative to the rectangular container 18 forming the enclosure means 12.

The storage means 28 may include an unillustrated exterior handle or the like mounted to a lower finished surface of the base panel 30 to effect telescoping lowering of the storage means 28 from the enclosure means 12. To effect retraction of the storage means 28 into the enclosure means 12, a retracting means 48 is provided. To this end, the retracting means 48, as illustrated in FIG. 4, may comprise at least one return spring 50, and preferably a pair of return springs, extending between an interior surface of the top wall 26 and an exterior surface of the top panel 34. The return springs 50 are preferably coupled to eye bolts engaged to the top wall 26 and the top panel 34 with the springs extending at an oblique angle relative to the top wall 26 and top panel 34. In other words, it is preferable that the return springs 50 extend between the storage means 28 and the enclosure means 12 to form an x-shape, as shown in FIG. 4. The return springs 50 are operable to effect retraction of the storage means 28 into the enclosure means 12 and retain the device 10 in such a retracted position, wherein the exterior surface of the base panel 30 is positioned flush against the exterior surface of the ceiling 16 so as to disguise the entire invention 10.

Figure 6:
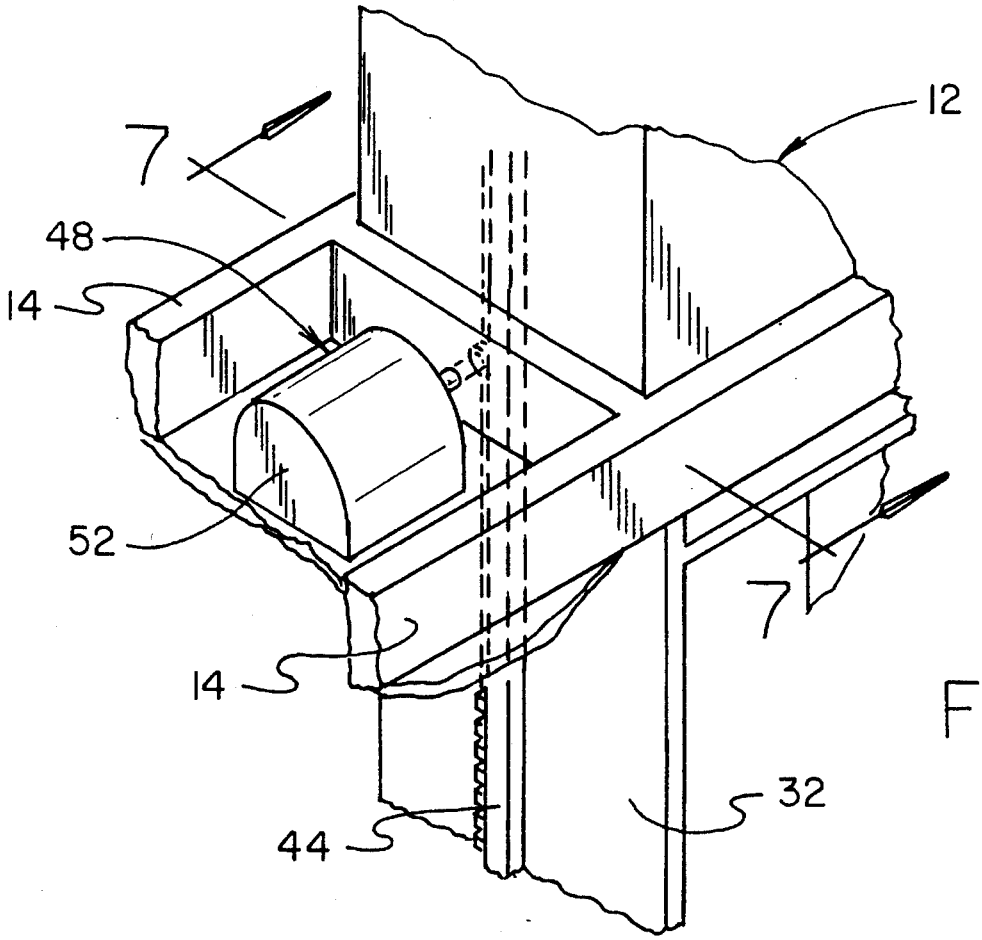
FIG. 6 is an enlarged isometric illustration of a portion of the present invention detailing an alternative retracting means.
Figure 7:
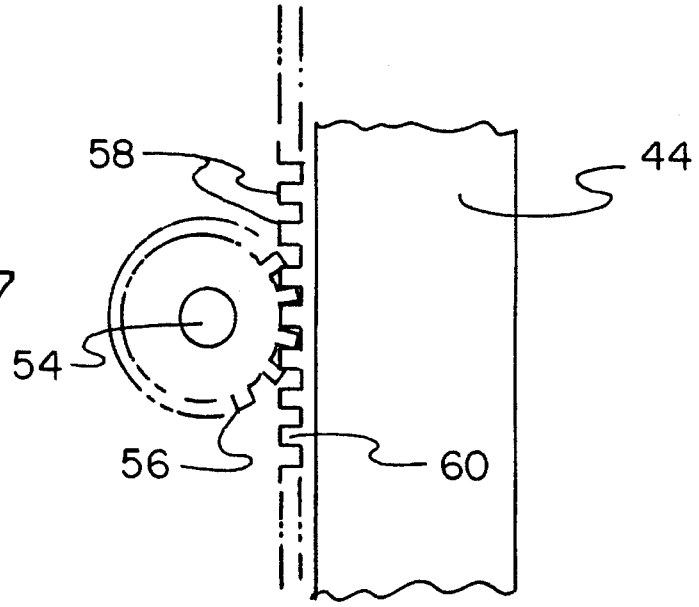
FIG. 7 is a cross-sectional view taken along line 7—7 of FIG. 6.

Turning now to FIGS. 6 and 7, it can be shown that the retracting means 48 may alternatively comprise an electric motor 52 secured to a portion of the ceiling structure 16. The electric motor 52 includes a motor shaft 54 directed through one of the side walls 24 of the enclosure means 12 proximal to one of the longitudinal projections 44. A pinion 56 secured to the motor shaft 54 engages a plurality of rack teeth 58 of a rack 60 integrally or otherwise fixedly secured along a lateral edge of the longitudinal projection 44. By this structure, an energization of the electric motor 52 will effect rotation of the pinion 56 to cause subsequent translation of the rack 60, and the associated storage means 28 in a desired direction. Thus, the electric motor 52 may be energized to retract or extend the storage means 28 relative to the enclosure means 12. Although not specifically illustrated, suitable latching means may be provided to lock the device 10 in a desired position so as to retain the storage means 28 within the enclosure means 12 as desired.

In use, the telescoping ceiling closet 10 may be readily installed into a ceiling structure 16 of a house or the like, wherein objects such as clothing and other goods may be stored within the storage means 28 and positioned into the enclosure means 12. The rectangular container 18 of the enclosure means 12 can be formed of a fiberglass material or the like and is preferably airtight along the wall connections 20–26 such that insulation dust and the like residing above the ceiling 16 will not enter the storage means 28.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A telescoping ceiling closet combination with a textured ceiling of a building structure comprising, in combination:

an enclosure means for receiving and storing objects therewithin mounted between spaced joists above said ceiling of said building structure centered above an aperture in said ceiling, said enclosure means comprising a container having a substantially rectangular cross section and including a front wall spaced from a rear wall, with a pair of side walls extending orthogonally between said front and rear walls; and a top wall extending orthogonally across upper edges of said front and rear walls and said side walls to close an upper end of said rectangular container, said rectangular container including an open lower end positionable into flush engagement with said ceiling;

a storage means slidably mounted within an interior of said enclosure means for receiving and supporting objects to be stored within said enclosure means, said storage means comprising a substantially rectangular base panel having an exterior texture matching said ceiling; a pair of vertical panels orthogonally extending from an unfinished side of said base panel in a substantially parallel, spaced relationship relative to one another; a top panel extending orthogonally between upper edges of said vertical panels; a hanger bar extending between said vertical panels; and a shelf panel orthogonally extending between said vertical panels to divide said storage means into a main compartment and an auxiliary compartment;

wherein said enclosure means includes opposed pairs of spaced guide rails positioned along opposed interior surfaces of said rectangular container, and further wherein said vertical panels each include a longitudinal projection extending along an exterior surface thereof and received within an individual one of said pairs of spaced guide rails to guide said storage means into said enclosure means during telescoping movement of said storage means into said rectangular container; and, a retracting means for effecting retraction of said storage means into said enclosure means, said retracting means comprising a pair of return springs extending between an interior surface of said top wall of said rectangular container and an exterior surface of said top panel of said storage means, said return springs extending at an oblique angle relative to said top wall and said top panel.

2. A telescoping ceiling closet for use in association with a textured ceiling of a building structure comprising, in combination:

an enclosure means for receiving and storing objects therewithin mountable between spaced joists above said ceiling of said building structure centered above an aperture in said ceiling, said enclosure means comprising a container having a substantially rectangular cross section and including a front wall spaced from a rear wall, with a pair of side walls extending orthogonally between said front and rear walls; and a top wall extending orthogonally across upper edges of said front and rear walls and said side walls to close an upper end of said rectangular container, said rectangular container including an open lower end positionable into flush engagement with said ceiling;

a storage means slidably mounted within an interior of said enclosure means for receiving and supporting objects to be stored within said enclosure means, said storage means comprising a substantially rectangular base panel having an exterior texture matching said ceiling; a pair of vertical panels orthogonally extending from an unfinished side of said base panel in a substantially parallel, spaced relationship relative to one another; a top panel extending orthogonally between upper edges of said vertical panels; a hanger bar extending between said vertical panels; and a shelf panel orthogonally extending between said vertical panels to divide said storage means into a main compartment and an auxiliary compartment;

wherein said enclosure means includes opposed pairs of spaced guide rails positioned along opposed interior surfaces of said rectangular container, and further wherein said vertical panels each include a longitudinal projection extending along an exterior surface thereof and received within an individual one of said pairs of spaced guide rails to guide said storage means into said enclosure means during telescoping movement of said storage means into said rectangular container; and, a retracting means for effecting retraction and extension of said storage means relative to said enclosure means, said retracting means comprising an electric motor securable to a portion of said ceiling structure, said electric motor including a motor shaft directed through one of said side walls of said enclosure means proximal to one of said longitudinal projections, said one of said longitudinal projections having a rack formed thereon defined by a plurality of spaced rack teeth; and a pinion secured to said motor shaft, said pinion engaging said plurality of rack teeth of said rack.

* * * * *